US007753228B2

(12) United States Patent
Yuhara

(10) Patent No.: US 7,753,228 B2
(45) Date of Patent: Jul. 13, 2010

(54) COSMETIC CONTAINER

(75) Inventor: Yukitomo Yuhara, Chiba (JP)

(73) Assignee: Yoshida Industry Co., Ltd., Tokyo (JP)

( * ) Notice: Subject to any disclaimer, the term of this patent is extended or adjusted under 35 U.S.C. 154(b) by 848 days.

(21) Appl. No.: 10/576,078

(22) PCT Filed: Oct. 8, 2004

(86) PCT No.: PCT/JP2004/014953

§ 371 (c)(1),
(2), (4) Date: Jan. 17, 2007

(87) PCT Pub. No.: WO2005/037015

PCT Pub. Date: Apr. 28, 2005

(65) Prior Publication Data

US 2007/0215494 A1 Sep. 20, 2007

(30) Foreign Application Priority Data

Oct. 16, 2003 (JP) ..... 2003-356887

(51) Int. Cl.
*B65D 43/16* (2006.01)
*B65D 43/22* (2006.01)
*B65D 43/24* (2006.01)
*B65D 51/04* (2006.01)

(52) U.S. Cl. ..... 220/835; 220/4.22; 220/830; 220/844

(58) Field of Classification Search ..... 220/835, 220/831, 830, 838, 844, 4.22, 4.24
See application file for complete search history.

(56) References Cited

U.S. PATENT DOCUMENTS 1,950,465 A * 3/1934 Whitlock ..... 220/315
2,245,487 A * 6/1941 Machin ..... 220/259.2

(Continued)

FOREIGN PATENT DOCUMENTS

FR 2 825 983 A1 12/2002

(Continued)

OTHER PUBLICATIONS

Supplementary European Search Report, mailed May 4, 2009, directed to counterpart European Patent Application No. EP04792221.6; 3 pages.

(Continued)

*Primary Examiner*—Anthony Stashick
*Assistant Examiner*—Niki M Eloshway
(74) *Attorney, Agent, or Firm*—Morrison & Foerster LLP

(57) ABSTRACT

A case body is provided with a cover which opens from and closes against the case body. The cover includes a hinge boss rotatably attached to the case body through a hinge pin. On the opposite side of the hinge pin is provided a hook mechanism with which the cover is engaged with the case body to form a closed state. A pressure member contacts and presses to the hinge boss to reduce the rotation speed of the hinge boss. A radius reduction portion is formed so that the outer dimension of the hinge boss is reduced gradually as the cover is getting closer to its full-opened position in order to weaken a frictional contact function with the pressure member.

3 Claims, 3 Drawing Sheets

U.S. PATENT DOCUMENTS

| | | | | |
|---|---|---|---|---|
| 2,295,494 | A | 9/1942 | Valentine | |
| 2,557,048 | A * | 6/1951 | Haase | 220/830 |
| 3,308,835 | A * | 3/1967 | Silverberg et al. | 220/263 |
| 4,822,965 | A * | 4/1989 | Hyogo et al. | 200/333 |
| 4,917,131 | A * | 4/1990 | Contreras, Sr. | 132/301 |
| 5,320,239 | A * | 6/1994 | Favre | 220/830 |
| 5,417,350 | A * | 5/1995 | Koo | 222/556 |
| 5,568,820 | A * | 10/1996 | Dirksing | 132/315 |
| 2003/0000955 | A1 * | 1/2003 | Lee | 220/830 |
| 2005/0236412 | A1 * | 10/2005 | Zethoff et al. | 220/254.5 |
| 2006/0191948 | A1 * | 8/2006 | Wisniewski et al. | 220/831 |
| 2007/0181575 | A1 * | 8/2007 | Yamanaka | 220/4.27 |

FOREIGN PATENT DOCUMENTS

| | | |
|---|---|---|
| JP | 06-46614 U | 6/1994 |

OTHER PUBLICATIONS

International Search Report, mailed Jan. 18, 2005, directed to counterpart International Patent Application No. PCT/JP2004/014953; 2 pages.

* cited by examiner

COSMETIC CONTAINER

TECHNICAL FIELD

The present invention relates to a cosmetic container with a cover adapted to rotate on a gentle pace, in which it is realized to improve operability for opening and closing the cover with use of a hook mechanism.

BACKGROUND ART

Conventionally, there have been known cosmetic containers whose covers are urged to their opened positions by biasing means such as a spring, but are designed to move comparatively slowly. For example, Japanese Utility Model Application Laid-Open Publication No. 6-46614 discloses a cosmetic container, in which a substantially-semi-cylindrical portion is formed at the bottom of a cover-rotatably-attached portion in such a way that the semi-cylinder's radius about its rotation axis is gradually reduced as going backward, and a sliding projection is formed from the rear wall of the container to be pressed to the substantially-semi-cylindrical portion strongly enough to cause a friction between therewith during the cover's movement. With this friction, the biasing force of the torsion spring for opening-up can be adjusted, so that a gentle movement of the cover is realized. As a result, the cosmetic powder within the container is prevented from scattering which otherwise might be caused by an impact of opening-up. In addition, in the above-mentioned way, the friction between the substantially-semi-cylindrical portion and the sliding projection is gradually reduced, the cover is prevented from halting halfway which otherwise might be caused by a diminution of the biasing force of the torsion spring during the cover's rotation.

Problems to be Solved by the Present Invention

In the above-mentioned cosmetic container, the sliding projection is positioned so as to be right on the line drawn between the cover-rotatably-attached portion 14, in particular a hinge pin as a rotation axis, and a hook means with which the cover is engaged with the container to form a closed state. A friction is generated between the sliding projection and the cover-rotatably-attachment portion. With this structure, the cover is pressed to the rear of the container at the same time as the sliding projection presses the cover-rotatably-attachment portion. Due to this backward pressure on the cover, a disadvantage is brought about. That is, when the cover is being closed to be engaged with the container, a tensile force to pull the cover is generated between the hook means and the cover-rotatably-attached portion, in addition to the sliding friction between the sliding projection and the cover-rotatably-attached portion. As a result, it becomes tougher and heavier for a user to engage the hook, and its operability is deteriorated. Moreover, a considerable power is also required to disengage the hook to open the cover, because the tensile force to pull the cover backward is working. As in the case of closing, the operability for opening leaves room to be improved.

The present invention has been contrived in consideration of the above circumstances. It is an object of the present invention to provide a cosmetic container with a cover adapted to rotate on a gentle pace, in which it is realized to improve operability for opening and closing the cover with use of a hook mechanism.

Means to Solve the Problems

According to the present invention, it is provided a cosmetic container, comprising a case body is provided with a cover which includes a hinge boss rotatably attached to the case body through a hinge pin, and opens from and closes against the case body; wherein the case body is further provided with a hook mechanism which is placed on the opposite side of the hinge pin, and with which the cover is engaged with the case body to form a closed state; wherein the case body is still further provided with a pressure member which causes a frictional contact with the hinge boss to slow down the rotation speed of the hinge boss; and wherein the hinge boss is provided with a radius reduction portion which is formed by that the outer dimension of the hinge boss is reduced gradually as the cover is getting closer to its full-opened position, for the purpose of weakening a frictional contact function with the pressure member, characterized in that the frictional contact between the pressure member and the hinge boss is generated at a position apart from the line drew between the hinge pin and the hook mechanism; and the radius reduction portion is formed to start at where the cover has been opened to reach a position of 90 degrees from its closed position, and spread to the cover's full-opened position.

REFERENCE NUMBERS

Figure 1:
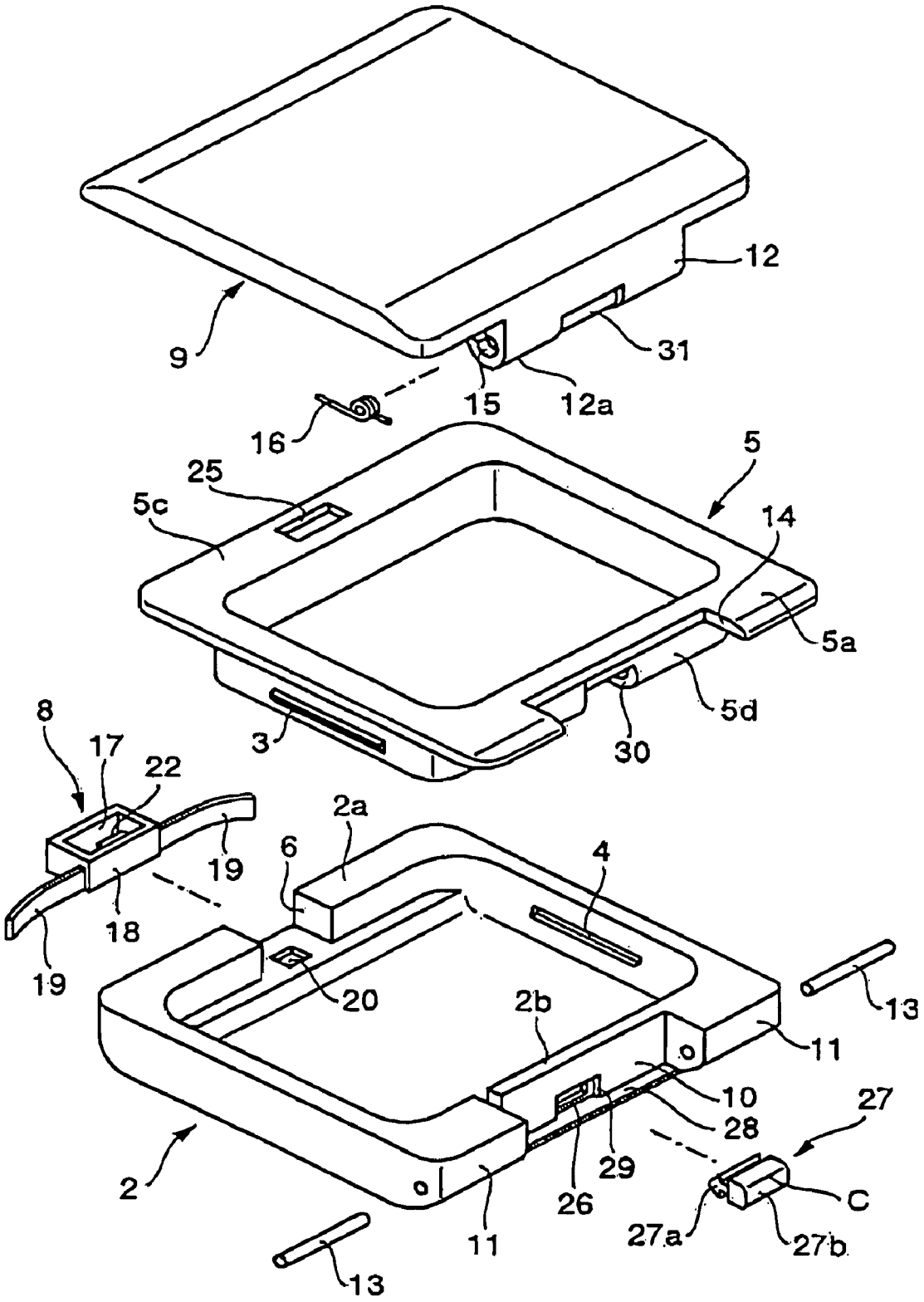
FIG. 1 is an exploded perspective view showing a preferred embodiment of a cosmetic container according to the present invention.

1 cosmetic container
2 case body
7 hook mechanism
9 cover
12 hinge boss
13 hinge pin
27 pressure member
31 radius reduction portion

BEST MODE FOR CARRYING OUT THE INVENTION

Figure 2:
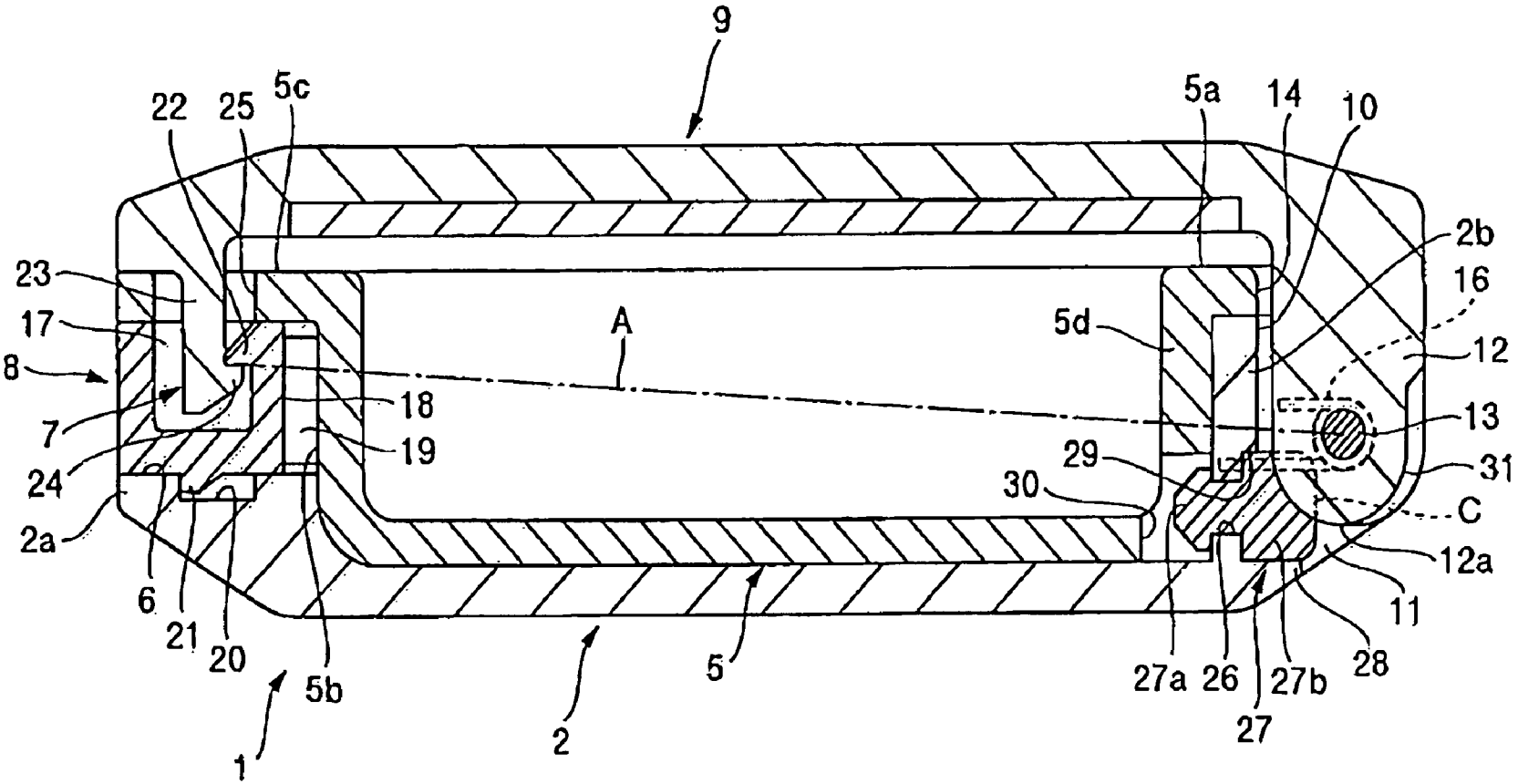
FIG. 2 is a sectional side view of the cosmetic container shown in FIG. 1.
Figure 3:
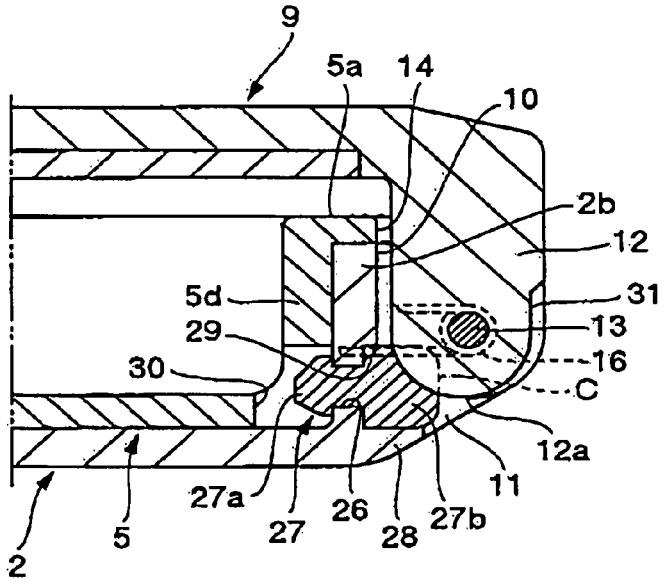
FIG. 3 is a sectional side view with principal parts enlarged, showing the cosmetic container in FIG. 1.
Figure 4:
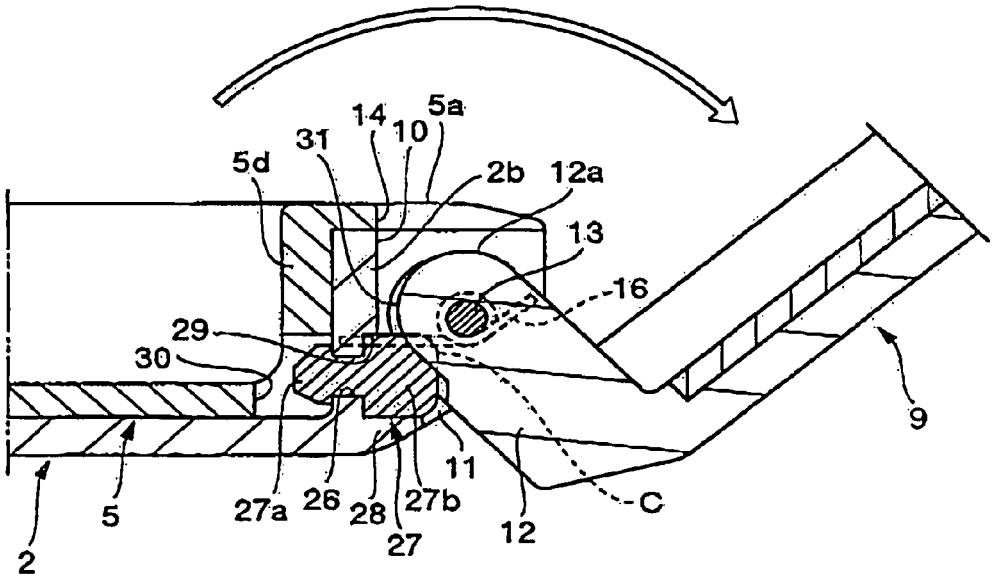
FIG. 4 is a sectional side view with principal parts enlarged, showing the process for opening the cover of the cosmetic container in FIG. 1.

Now, a preferred embodiment of a cosmetic container according to the present invention is described in detail with reference to the accompanying drawings. As shown in FIGS. 1 to 4, a cosmetic container of the present invention is assembled as follows: an internal tray 5, in which a cosmetic filled tray is installed, is mounted in a tray-like case body 2 by engaging an internal-tray convex 3 with a main-case concave 4; a push-piece 8, which is provided as means of releasing a hook mechanism 7 described later, is placed into a cutout space 6 formed on a front wall 2*a* of the case body 2; a cover, 9 which opens from or closes against the case body 2, is rotatably attached to a rear wall 2*b* of the case body 2.

The center of the rear wall 2*b* of the case body 2 is recessed to form a hinge concave 10, and on both of the right and left sides thereof, hinge projections 11 are formed correspondingly. A hinge boss 12 is disposed vertically suspended from the rear extremity of the cover 9 in the direction for the hinge concave 10. By inserting the hinge boss 12 between hinge projections 11, and placing a hinge pin 13 through the hinge projections 11 and the hinge boss 12, the hinge boss 12 i.e., the cover 9 is attached to the case body 2 so as to be rotatable upward and downward by means of the hinge pin 13.

In order for the hinge boss 12 to rotate smoothly within the hinge concave 10, a surface where is supposed to be the bottom of the hinge boss 12 in the cover's closed position is curved to form a substantially-semi-cylindrical portion 12*a*, which has a certain radius about the hinge pin 13. A rear brim 5*a* is formed on the internal tray 5 so as to cover the rear wall 2*b* of the case body 2, and for the hinge boss to be set in, a cutout space 14 is formed on the rear brim 5*a* in accordance with the hinge concave 10 of the case body 2. A torsion spring hollow 15 is formed on one of the hinge boss 12's side ends which face hinge projections 11. A torsion spring 16 is placed in the torsion spring hollow 15, with one end attached to the case body 2, and the other end to the hinge boss 12. The torsion spring 16 functions to keep urging the cover 9 to the cover's opened position with a reaction force against the case body 2.

Meanwhile, the push-piece 8 comprises: a box-shaped push-piece body 18 with an open-top push-piece convex 17 therein; a pair of elastic foot pieces 19 which are formed by extending the push-piece body 8 to the right and left sides respectively, and are abutted against the front wall 5*b* of the internal tray 5 to constantly push and bias forward the push-piece body 8; and a latch convex 21 which is provided under the bottom of the push-piece body 18, and is inserted in a latch concave 20 so as to be slideable backward and forward, while the latch concave 20 is provided on the inner surface of the cutout space 6 of the case body 2. The latch convex 21 is caught at the front end of the latch concave 20 with the biasing force of the elastic foot pieces 19, having the push-piece body 18 held within the cutout space 6. In this way, the push-piece 8 is attached to the case body 2 so that it can go forward with elastic return and backward by pushing operation.

In addition, on the inner surface of the push-piece convex 17 within the push-piece body 18, a hook projection 22 is formed forward from a rear wall of the push-piece body 18. The cover 9 is provided with a hook boss 23 vertically suspended so as to be reachable to the inside of the push-piece convex 17. On the back side of the hook boss 23 is formed a hook convex 24 which protrudes backward to mate with the hook projection 22 easily detachably. In this way, the hook mechanism 7, with which the cover 9 is hooked up with the case body 2 to form a closed state, is established on the opposite side of the hinge pin 13 which is on the rear of the case body 2. On the front brim 5*c* of the internal tray 5 which covers the front wall 2*a* of the case body 2, a hook aperture 25 is provided in accordance with the push-piece convex 17 of the push-piece 8, allowing the hook boss 23 to vertically go through the internal tray 5.

Meanwhile, a pressure member aperture 26 is provided on the lower center portion of the rear wall 2*b* of the case body 2, for setting a pressure member 27 through the wall 2*b* in the hinge concave 10. The pressure member 27 functions to cause a frictional contact with the hinge boss 12 to reduce the rotation speed. The pressure member 27 is made of flexible elastic material such as silicon rubber, and is comprised of an attachment portion 27*a* being inserted through the pressure member aperture 26, and a pressure portion 27*b* protruding into the hinge concave 10 which accommodates the hinge boss 12. Particularly, the pressure portion 27*b* of the pressure member 27 is set to cause a frictional contact with the substantially-semi-cylindrical portion 12*a* at the bottom of the hinge boss 12, which is at a lower position than the hinge pin 13. In this way, the frictional contact between the pressure portion 27*b* and the hinge boss 12 is generated at a position apart from the line (shown as alternate long and short dashed lines A in FIG. 2) drawn between the hinge pin 13 and the engagement position of the hook projection 22 with the hook convex 24.

More particularly, the pressure portion 27*b* is formed as a rectangular block shape with a considerable width extending in the hinge concave 10, so that an upper corner C of the pressure portion 27*b* is pressed to the substantially-semi-cylindrical portion 12*a* over a considerably long width. For preventing the upper corner C from being forced down with the pressure from the hinge boss 12, the pressure portion 27*b* is supported from under by a rear bottom projection 28, which is formed by protruding into the hinge concave 10 from the rear wall 2*b* of the case body 2. In addition, a perimeter ditch 29 is formed along the rim of the pressure member aperture 26 on the side facing the hinge concave 10, in order to prevent the deformation of the rim and secure an appropriate sliding friction. On the rear wall 5*d* of the internal tray 5, a pressure member hollow 30 is formed in accordance with the position of the pressure member aperture 26, to prevent the attachment portion 27*a* of the pressure member 27 from conflicting therewith.

The shape of the substantially-semi-cylindrical portion 12*a* of the hinge boss 12 which contacts and presses the pressure member 27, is designed for reducing the frictional contact function gradually as the cover 9 is getting closer to its full-opened position, that is, a radius reduction portion 31 is formed by reducing the radius of the substantially-semi-cylindrical portion 12*a* centered about the hinge pin 13, gradually as going backward. In the embodiment of the drawings, the radius reduction portion 31 is formed as a ditch by caving the appropriate part to contact with the pressure member 27. In particular, the radius reduction portion 31 is formed to start at where the cover 9 stands at 90 degrees from its closed position, and spread to the cover's full-opened position.

It might be considered first to form the radius reduction portion 31 as it starts immediately after the closing of the cover is disengaged, i.e., the cover 9 has just started to open. As to the movement of the cover 9 in opening, however, the weight of the cover 9 should be taken into consideration. Here, a detailed explanation is given, taking the case that the cover 9 is lifted by means of the torsion spring 16. The weight of the cover 9 is relatively heavy in the beginning of the cover's opening. Therefore, it is considered reasonable that the sliding friction function is adjusted weak at first, and is made stronger once the cover 9 has stood up and its weight has become less. Meanwhile, the biasing force of the torsion spring 16 is strong at first, and then is gradually getting weaker. Therefore at this time, it is considered reasonable to make the sliding friction function strong first, and weaker later.

Considering well the above-mentioned circumstances, the provided embodiment takes the following measures: to design the torsion spring to have a power strong enough to lift up the cover 9 whose weight load is carefully considered in advance; and to form the radius reduction portion 31 backward from where the cover 9 has reached a position of approximately 90 degrees from its closed position, i.e., where the cover 9 has almost finished to be lifted up and stands upright to the case body 2, rather than where the cover 9 has just started to open. As a result, the spring force can lift up the cover 9 by itself, and although the spring force is getting weaker, the radius reduction portion 31 complements the weakened biasing force of the spring to cover the remaining rotation toward the full-opened position.

A cosmetic container 1 according to the present embodiment functions as follows. To start to open the cover 9 which is at its closed position, the push-piece 8 should be pushed backward, resisting the biasing force of the elastic foot pieces 9. Once the push-piece 8 has been pushed backward, the hook projection 22 of the push-piece 8 is disengaged from the hook convex 24 of the cover 9, and the engagement of the hook mechanism 7 is released. Then, the cover 9 is automatically lifted up due to the biasing force of the torsion spring 16, and the case body 2 is being opened. As the cover is being lifted, the hinge boss 12 is rotating backward, then a sliding friction between the hinge boss 12 and the pressure member 27 starts to be generated. Therefore, the rotation speed of the hinge boss 12 biased by the torsion spring 16 is reduced, and opening the cover 9 is carried out on a gentle pace.

Once the cover 9 has reached a position of 90 degrees from the cover's closed position, the radius reduction portion 31 of the hinge boss 12 starts to contact and presses to the pressure member 27. As the cover 9 is rotating, the biasing force of the torsion spring 16 is getting weaker. At the same time, the frictional contact function is also getting weaker. In this way, the cover can be fully opened even by the weakened biasing force of the spring.

On the other hand, for closing the cover 9, the cover 9 should be taken down toward the cover's closed position to cover over the case body 2. The hook boss 23 goes down through the hook aperture 25 into the push-piece convex 17 of the push-piece 8. Then, the hook convex 24 of the hook boss 23 presses the hook projection 22 backward within the push-piece convex 17, and affected by that, the push-piece 8 is also moved backward resisting the biasing force of the elastic foot pieces 19. In the end, the hook mechanism 7 is established by that the hook convex 24 is latched under the hook projection 22, at the same time the push-piece 8 is taken forward with the elastic return of the elastic foot pieces 19. The closing the cover 9 has been finished in this way.

Meanwhile, in the cosmetic container 1 of the present embodiment, the frictional contact between the pressure member 27 and the hinge boss 12 is generated at a position apart from the line drawn between the hinge pin 13 and the hook mechanism 7. Due to this structure, the pressure member 27 less presses the cover 9 toward the rear of the case body 2, and when the cover 9 is being closed, the tensile force to pull the cover 9 is prevented from being generated between the hinge pin 13 and the hook mechanism 7. Therefore, it becomes easier for a user not only to engage the hook mechanism 7 to close the cover 9, but also to disengage the hook mechanism 7 to open the cover 9 without a feeling of the cover 9 being pulled backward. In sum, it is realized to improve the operability of the cover 9 with use of the hook mechanism 7.

INDUSTRIAL APPLICABILITY

In a cosmetic container according to the present invention, with respect to a cosmetic container with a cover adapted to rotate on a pace, it is realized to improve an operability of opening and closing the cover with use of a hook mechanism.

What is claimed:

1. A cosmetic container, comprising:

a case body;

a cover which includes a hinge boss rotatably attached to the case body through a hinge pin and opens from and closes against the case body;

a torsion spring provided in the hinge boss, one end of the torsion spring being attached to the case body and the other end of the torsion spring being attached to the hinge boss, and the torsion spring applying a force against the case body so as to urge the cover to open;

a hook mechanism which is provided on the case body so as to be on the opposite side of the hinge pin and through which the cover engages with the case body to form a closed state, the hook mechanism comprising a push-piece body slidably provided at one end of the case body opposite from the hinge pin and a hook boss provided at one end of the cover to engage with the push-piece body when the cover is fully closed to form the closed state, the engagement of the push-piece and the hook boss being released when the push-piece is pushed toward the hinge pin; and a pressure member which is provided on the case body, causes a frictional contact with the hinge boss to reduce a rotation speed of the hinge boss, the hinge boss comprising a radius reduction portion which is formed so that an outer dimension of the hinge boss is reduced gradually as the cover is getting closer to its full-opened position so as to weaken the frictional contact with the pressure member, wherein the frictional contact between the pressure member and the hinge boss is generated at a position apart from the line drawn between the hinge pin and the hook mechanism, and the radius reduction portion is formed to start at where the cover has been opened to reach a position of 90 degrees from the closed state and is so configured that the frictional contact between the pressure member and the hinge boss is less when the cover opens beyond the 90 degree position than when the cover does not reach the 90 degree position.

2. The cosmetic container of claim 1, further comprising an internal tray mounted on the case body so as to be disposed between the case body and the cover in the closed state.

3. The cosmetic container of claim 2, wherein the internal tray has an aperture configured so that the hook boss goes through the aperture to engage with the push-piece body.

* * * * *